US011965270B2

(12) United States Patent
Lee

(10) Patent No.: US 11,965,270 B2
(45) Date of Patent: Apr. 23, 2024

(54) DEODORANT AND ANTIBACTERIAL COPPER NANOFIBER YARN AND MANUFACTURING METHOD THEREOF

(71) Applicant: QUANN CHENG INTERNATIONAL CO., LTD., Pingtung (TW)

(72) Inventor: Hsing Hsun Lee, Pingtung (TW)

(73) Assignee: QUANN CHENG INTERNATIONAL CO., LTD., Pingtung (TW)

( * ) Notice: Subject to any disclaimer, the term of this patent is extended or adjusted under 35 U.S.C. 154(b) by 190 days.

(21) Appl. No.: 17/349,371

(22) Filed: Jun. 16, 2021

(65) Prior Publication Data

US 2022/0356606 A1 Nov. 10, 2022

(30) Foreign Application Priority Data

May 7, 2021 (TW) ..... 110116527

(51) Int. Cl.

| | |
|---|---|
| ***D02G 3/12*** | (2006.01) |
| ***D01D 5/08*** | (2006.01) |
| ***D01F 8/18*** | (2006.01) |
| ***D02G 3/04*** | (2006.01) |
| ***D02G 3/36*** | (2006.01) |
| ***D02G 3/44*** | (2006.01) |

(52) U.S. Cl.

CPC ..... *D02G 3/12* (2013.01); *D01D 5/08* (2013.01); *D01F 8/18* (2013.01); *D02G 3/045* (2013.01); *D02G 3/36* (2013.01); *D02G 3/449* (2013.01)

(58) Field of Classification Search

None

See application file for complete search history.

(56) References Cited

U.S. PATENT DOCUMENTS 9,192,625 B1 * 11/2015 Joshi ..... D04H 1/00

FOREIGN PATENT DOCUMENTS

| | | | |
|---|---|---|---|
| JP | H10219512 | * | 8/1998 |
| KR | 20160053725 | * | 5/2016 |

OTHER PUBLICATIONS

Machine Translation of KR20160053725 (Year: 2016).*
Machine Translation of JPH10219512 (Year: 1998).*

* cited by examiner

*Primary Examiner* — Shawn Mckinnon

(74) *Attorney, Agent, or Firm* — Juan Carlos A. Marquez; Marquez IP Law Office, PLLC

(57) ABSTRACT

A deodorant and antibacterial copper nanofiber yarn and a manufacturing method thereof are provided, the manufacturing method including: providing a raw material, including a polyblend slurry, a nano-metal solution, a plurality of inorganic particles, and a plurality of TPU rubber particles; stirring the raw material into a mixed material; making second metal contact the first metal ion fiber to cause the first metal ion to undergo a reduction reaction to obtain a first metal nanoparticle; drying the mixed material; performing hot-melt spinning on the mixed material, the plurality of TPU rubber particles, after being hot-melted, being coated on an outer peripheral side of the spun wire to form a first-phase wire; forcibly cooling the first-phase wire; stretching the first-phase wire; air-cooling the first-phase wire to form a second-phase wire; and collecting the second-phase wire to make the wire into a finished deodorant and antibacterial copper nanofiber yarn.

12 Claims, 3 Drawing Sheets

DEODORANT AND ANTIBACTERIAL COPPER NANOFIBER YARN AND MANUFACTURING METHOD THEREOF

CROSS-REFERENCE TO RELATED APPLICATION

This application claims the benefit of Taiwan Patent Application No. 110116527, filed on 7 May 2021, which is hereby incorporated by reference for all purposes as if fully set forth herein.

BACKGROUND

Technical Field

The present invention mainly relates to a metal nanofiber yarn and a manufacturing method thereof, and in particular, to an antibacterial and deodorant metal fiber yarn and a manufacturing method thereof.

Related Art

With improved standard of living and increasing health-consciousness, functional textiles with antibacterial, mildew-resistant, or deodorant effects have gradually gained ground in the market as textiles are in contact with the bodies of users in daily life. For conventional fiber products made of deodorant or antibacterial fibers, the deodorant or antibacterial fibers of the fiber products have to be washable. In addition, considering wide applications, the deodorant fibers have to be dyed in the same way as conventional fiber products. In a conventional process, an organic antibacterial agent is usually applied to a surface of a fiber. However, some organic antibacterial agents are likely to produce toxic substances, have poor heat resistance, easy decomposability, or high volatility, or may cause problems such as antimicrobial resistance.

At present, common methods for manufacturing a functional fiber containing a metal material are as follows: 1. A metal material is mixed with an adhesive, and the mixture is directly applied to a surface of a fiber to obtain an antibacterial fiber. However, as the viscosity of the adhesive decreases over time, a content of the metal material on the surface of the fiber gradually decreases, which affects the antibacterial effect. 2. Metal ions in an electroplating solution are electroplated under an external electric field to form a metal coating on a surface of a fiber. However, this manufacturing method causes the problem of industrial wastewater pollution and restricts types of metal components.

An antibacterial mechanism of metal materials, especially an antibacterial principle of copper fiber, is as follows: when positively charged trace copper ions come into contact with negatively charged cell membranes of microorganisms, according to the Coulomb's law, the metal ions penetrate the cell membranes to enter bacteria, and react with sulfhydryl-amino groups on proteins in the bacteria, to destroy cell proteins and cause the death of microorganisms or the loss of proliferation.

In addition, current commercially available copper ion fibers use Dacron or nylon as a carrier, and the treatment method of adding near-nanometer copper powder or copper compound is polyblend, that is, simply mixing copper powder in a fiber. In this technique, a content of copper in the fiber does not exceed 1%, and copper is still prone to decrease over time similar to that in the foregoing method.

The use of Dacron or nylon as the carrier generally endows the copper ion fiber with poor hydrophilicity, and a moisture regain rate of the fiber is the same as that of the fibril. Fabrics made of commercially available copper ion fibers generally need more than 0-50% copper ions to achieve antibacterial and deodorant effects. Such fabrics have inadequate antibacterial and deodorant effects and high costs.

SUMMARY

An objective of the present invention is to provide a manufacturing method of a deodorant and antibacterial copper nanofiber yarn, and the manufacturing method is applicable to simple and economical equipment. The manufacturing method is a coherent operation technique including yarn spinning, wire forming, and deodorant and antibacterial fiber manufacturing.

To achieve the foregoing objective, the present invention provides a manufacturing method of a deodorant and antibacterial copper nanofiber yarn, steps of the method including: providing a raw material, including a polyblend slurry, a nano-metal solution, a plurality of inorganic particles, and a plurality of thermoplastic polyurethane (TPU) rubber particles, the polyblend slurry including a first fiber yarn slurry and a second fiber yarn slurry, the nano-metal solution containing a first metal ion; stirring the raw material into a mixed material, and making the nano-metal solution contact the polyblend slurry to form a first metal ion fiber containing the first metal ion; making second metal contact the first metal ion fiber to cause the first metal ion to undergo a reduction reaction to obtain a first metal nanoparticle, the copper nanofiber yarn containing the first metal nanoparticle obtained by reducing the first metal ion; drying the mixed material to remove moisture; performing hot-melt spinning on the mixed material in a spinning machine to spin a yarn from an outlet of the spinning machine to form a primary wire, the plurality of TPU rubber particles, after being hot-melted, being further coated on an outer peripheral side of the primary wire spun from the outlet to form a first-phase wire; forcibly cooling the first-phase wire to perform a first cooling on the wire to shape a surface of the first-phase wire; stretching the cooled first-phase wire through a stretching apparatus for stretching; cooling the first-phase wire to perform a second cooling on the wire to shape an inside of the first-phase wire to form a second-phase wire; and collecting the second-phase wire to make the wire into a finished deodorant and antibacterial copper nanofiber yarn.

In some embodiments, the first fiber yarn slurry is selected from a group consisting of a cotton fiber, a Dacron fiber, a viscose fiber, and a modal fiber.

In some embodiments, the TPU rubber particles include TPU, polyethylene (PE), polypropylene (PP), polyethylene terephthalate (PET), polyamide (PA), polybutylene terephthalate (PBT), ethylene-vinyl acetate (EVA) or nylon, and copper modified polyacrylonitrile (PAN).

In some embodiments, the plurality of inorganic particles are rare earth or mineral particle powders.

In some embodiments, the first metal ion is a copper ion, and the second metal includes magnesium metal, aluminum metal, manganese metal, titanium metal, zinc metal, iron metal, nickel metal, tin metal, copper metal, or silver metal.

In some embodiments, a standard reduction potential of the first metal ion is greater than a standard reduction potential of an ionic state of the second metal, and a standard reduction potential difference of the first metal ion is greater than a standard reduction potential difference of the ionic state of the second metal by 0.4 V to 4 V.

In some embodiments, a temperature for drying in step D is controlled in a range of 100° C. to 150° C.

In some embodiments, the first cooling in step F makes the first-phase wire continuously pass through a cooling tank, and the second cooling in step H is air cooling.

In some embodiments, the stretching apparatus of step G includes a plurality of roller sets arranged in sequence to stretch the first-phase wire.

Another objective of the present invention is to provide a deodorant and antibacterial copper nanofiber yarn. The yarn uses a new copper ion-containing wire as a fiber raw material, to make the deodorant and antibacterial effect last long.

To achieve the foregoing objective, the present invention provides a deodorant and antibacterial copper nanofiber yarn, manufactured by using the foregoing manufacturing method of a deodorant and antibacterial copper nanofiber yarn.

In some embodiments, an average particle size of a first metal nanoparticle is in a range of 1 nm to 100 nm.

In some embodiments, a content of the first metal nanoparticle in the copper nanofiber yarn is in a range of 10 μg to 100 mg per square centimeter of a fiber surface.

Characteristics of the present invention are as follows: the process of the present invention can be carried out at room temperature by using a simple method to obtain a nano-level metal fiber without the application of expensive environmental control equipment. Therefore, the present invention achieves low costs, reduced energy consumption, and lower thermal pollution. For the copper fiber of the present invention, a molecular structure of an acrylic fiber is modified. The copper element is grafted on a side chain of the acrylic fiber to form a straight macromolecule containing organic copper. The treatment method is copolymerization. Two different polymer chains are connected by chemical bonds, one of which is a polymer backbone (skeleton) including one unit, i.e., a main chain, and the other is a polymer branch including another unit, i.e., a branch. The grafting methods include "grafting onto", "grafting from", and "grafting through". During the treatment of the copper fiber in the present invention, a hydrophilic group is specially introduced, so that the fiber has better hydrophilicity than cotton.

DETAILED DESCRIPTION

Figure 1:
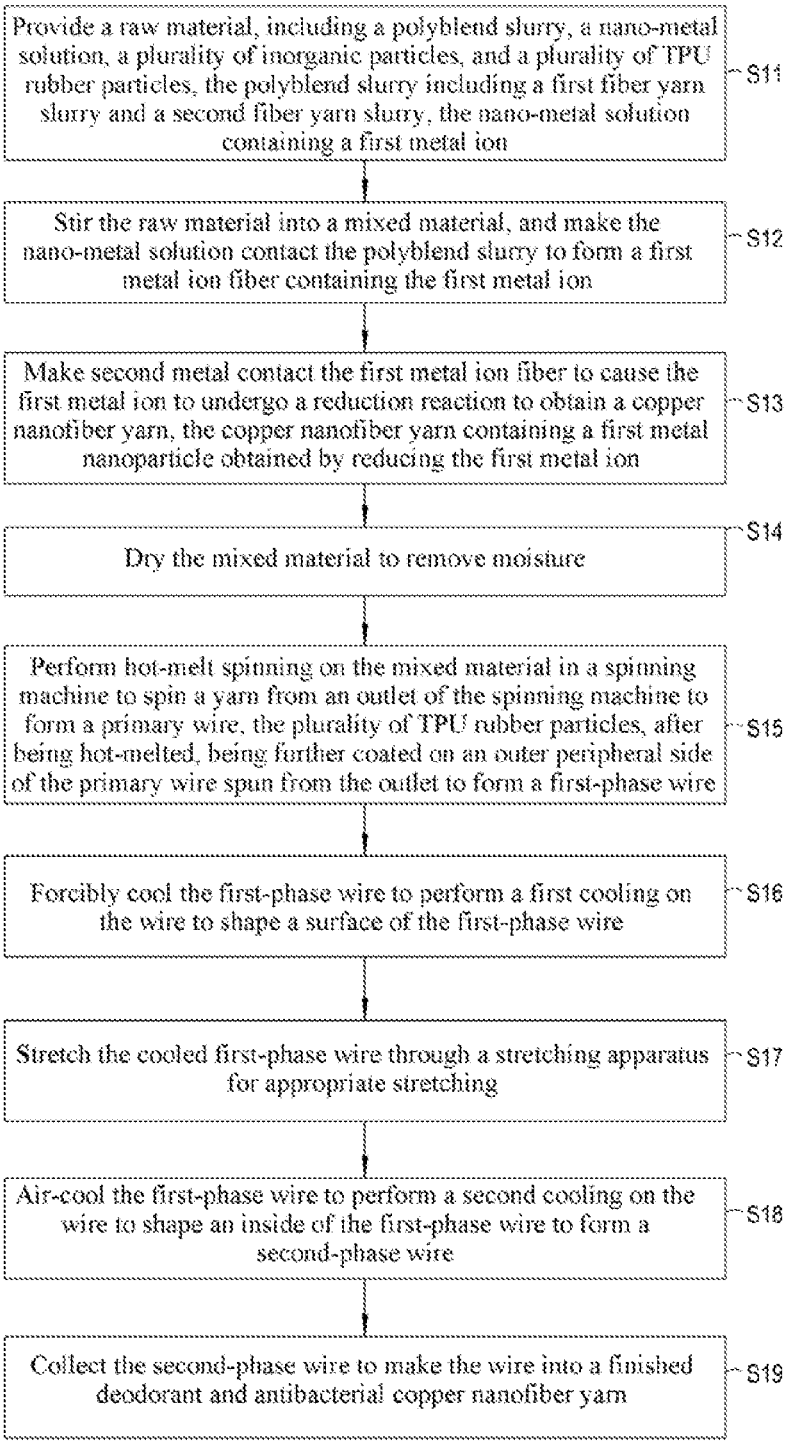
FIG. 1 is a flowchart of steps of a manufacturing method of a deodorant and antibacterial copper nanofiber yarn according to an embodiment of the present invention.

Embodiments of the present invention are described in detail below with reference to the accompanying drawings, the accompanying drawings are mainly simplified schematic diagrams, and only exemplify the basic structure of the present invention schematically. Therefore, only the components related to the present invention are shown in the drawings, and are not drawn according to the quantity, shape, and size of the components during actual implementation. During actual implementation, the type, quantity, and proportion of the components may be changed, and the layout of the components may be more complicated.

The following description of various embodiments is provided to exemplify the specific embodiments of the present invention with reference to accompanying drawings. The directional terms mentioned in the present invention, for example, "upper", "lower", "before", "after", "left", "right", "inside", "outside", and "side", are only references to the directions in the drawings. Therefore, the used terms about directions are used to describe and understand the present invention, and are not intended to limit the present invention. In addition, in the specification, unless explicitly described as contrary, the word "include" is understood as referring to including the element, but does not exclude any other elements.

Figure 2:
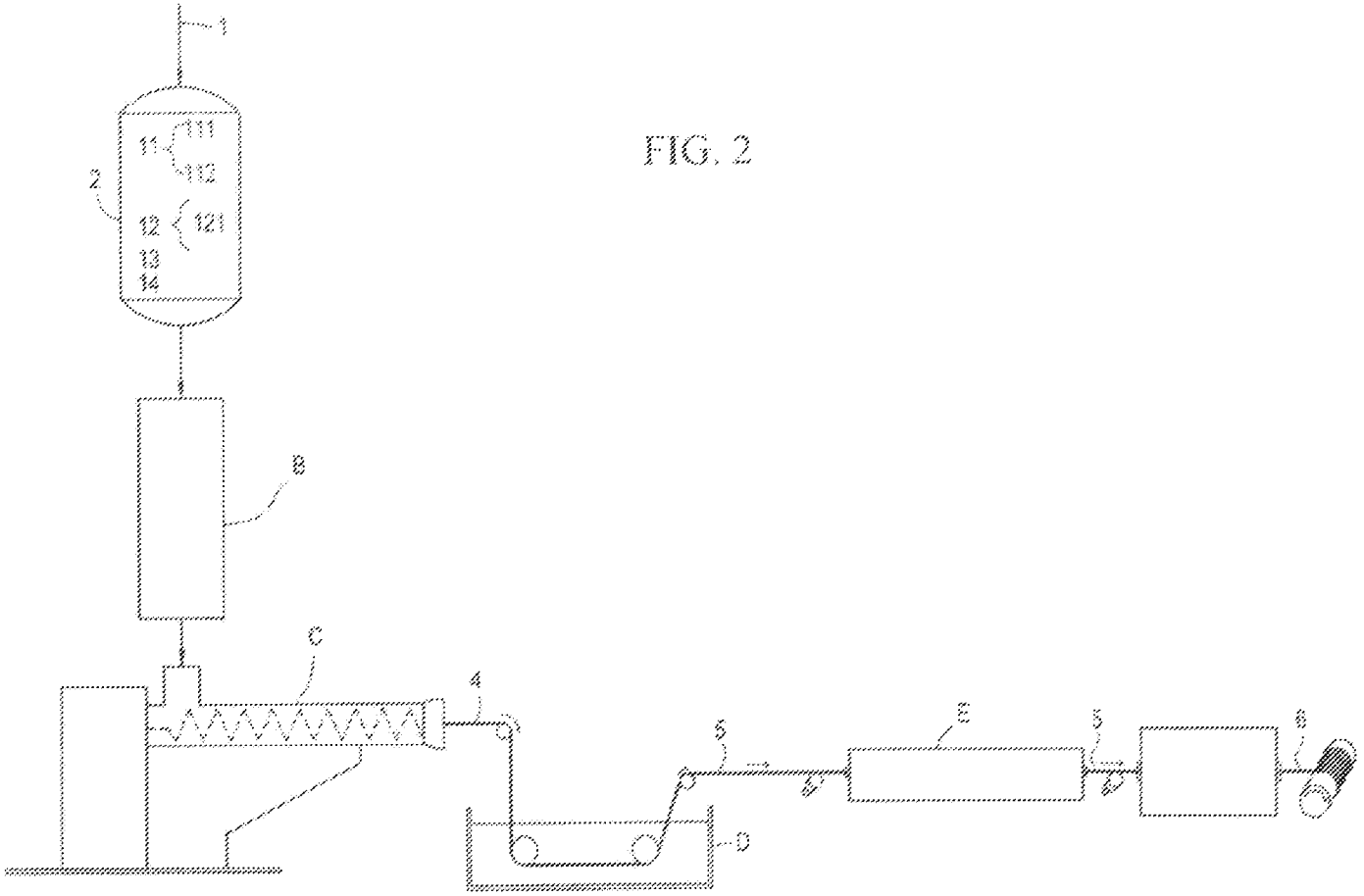
FIG. 2 is an equipment system diagram corresponding to a manufacturing method of a deodorant and antibacterial copper nanofiber yarn according to an embodiment of the present invention.

Refer to FIG. 1 and FIG. 2. Steps of the manufacturing method of a deodorant and antibacterial copper nanofiber yarn in this embodiment includes at least S11 to S19. Step S11: Provide a raw material 1, including a polyblend slurry 11, a nano-metal solution 12, a plurality of inorganic particles 13 (for example, rare earth or mineral particle powders), and a plurality of TPU rubber particles 14, the polyblend slurry 11 including a first fiber yarn slurry 111 and a second fiber yarn slurry 112, the nano-metal solution 12 containing a first metal ion 121.

Step S12: Stir the raw material 1 in a mixing tank A into a mixed material 2, and making the nano-metal solution 12 contact the polyblend slurry 11 to form a first metal ion fiber 21 containing the first metal ion. The first metal ion 21 may be a copper ion.

Step S13: Make second metal 3 contact the first metal ion fiber 21 to cause the first metal ion to undergo a reduction reaction, i.e., to cause the first metal ion fiber 21 to obtain an electron, to obtain a copper nanofiber yarn, the copper nanofiber yarn containing a first metal nanoparticle obtained by reducing the first metal ion. The second metal may include magnesium metal, aluminum metal, manganese metal, titanium metal, zinc metal, iron metal, nickel metal, tin metal, copper metal, or silver metal.

Step S14: Dry the mixed material 2 to remove moisture. The foregoing drying operation may be performed in an oven B, and a temperature of the oven B may be controlled in a range of 100° C. to 150° C. However, the temperature control of the oven is not limited to this.

Figure 3:
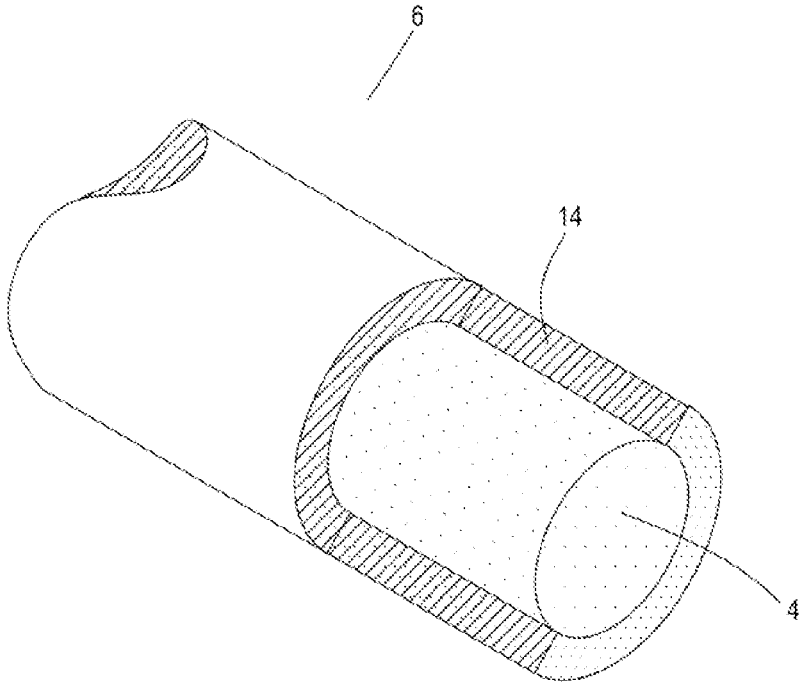
FIG. 3 is a three-dimensional schematic sectional view of a deodorant and antibacterial copper nanofiber yarn according to an embodiment of the present invention.

Step S15: Deliver the mixed material 2 into a spinning machine C, perform hot-melt spinning on the mixed material 2 by using the spinning machine C to spin a yarn 4 from an outlet of the spinning machine C to form a primary wire, the plurality of TPU rubber particles 14, after being hot-melted by the spinning machine C, being further coated on an outer peripheral side of the primary wire (as shown in FIG. 3) at the outlet of the spinning machine C to form a first-phase wire 5.

Step S16: Deliver the first-phase wire 5 into a cooling tank D to perform forced cooling, which is a first cooling, and a surface of the first-phase wire 5 can be shaped.

Step S17: Deliver the first-phase wire 5 after the first cooling into a stretching apparatus E to stretch the cooled first-phase wire 5 to adjust a wire gauge to an appropriate size. The stretching apparatus E includes a plurality of roller sets arranged in sequence, and makes the first-phase wire 5 wound around the roller sets, so that the wire can be stretched to control the wire gauge.

Step S18: Cool, for example, air-cool, the first-phase wire 5 to perform a second cooling, where this cooling can shape an inside of the first-phase wire 5 to form a second-phase wire 6.

Step S19: Collect the second-phase wire 6, for example, wind the second-phase wire 6 into a roll by using a winding method, to make the wire into a finished deodorant and antibacterial copper nanofiber yarn.

The first fiber yarn slurry 111 may be any group consisting of a cotton fiber, a Dacron fiber, a viscose fiber, and a modal fiber, such as a single fiber or a combination of any of the foregoing fibers.

In addition, the TPU rubber particles 14 may include TPU, PE, PP, PET, PA, PBT, EVA or nylon, and copper modified PAN.

In the foregoing procedure, a standard reduction potential of the first metal ion is greater than a standard reduction potential of an ionic state of the second metal 3, and a standard reduction potential difference of the first metal ion is greater than a standard reduction potential difference of the ionic state of the second metal 3 by 0.4 V to 4 V.

Refer to FIG. 3. The deodorant and antibacterial copper nanofiber yarn of this embodiment is the second-phase wire 6 manufactured by using the manufacturing method in the foregoing embodiments. An average particle size of a first metal nanoparticle is in a range of 1 nm to 100 nm. In addition, in the second-phase wire 6, a content of the first metal nanoparticle in the copper nanofiber yarn is in a range of 10 μg to 100 mg per square centimeter of a fiber surface.

Based on the above, in the present invention, a nano-level metal fiber can be manufactured at room temperature by using a simple method without the application of expensive environmental control equipment, and then made into a copper nanofiber yarn product. Therefore, the present invention achieves low costs, reduced energy consumption, and lower thermal pollution.

The above embodiments merely exemplify the principles, features, and effects of the present invention, but are not intended to limit the implementation scope of the present invention. A person skilled in the art can modify or change the above embodiments without departing from the spirit and scope of the present invention. Any equivalent change or modification made using the contents disclosed by the present invention shall fall within the scope of the claims below.

What is claimed is:

1. A manufacturing method of a deodorant and antibacterial copper nanofiber yarn, steps of the method comprising:

(A) providing a raw material, comprising a polyblend slurry, a nano-metal solution, a plurality of inorganic particles, and a plurality of thermoplastic polyurethane (TPU) rubber particles, the polyblend slurry comprising a first fiber yarn slurry and a second fiber yarn slurry, the nano-metal solution containing a first metal ion wherein the first metal ion is a copper ion;

(B) stirring the raw material into a mixed material, and making the nano-metal solution contact the polyblend slurry to form a first metal ion fiber containing the first metal ion;

(C) making second metal contact the first metal ion fiber to cause the first metal ion to undergo a reduction reaction to obtain a first metal nanoparticle, the copper nanofiber yarn containing the first metal nanoparticle obtained by reducing the first metal ion;

(D) drying the mixed material to remove moisture;

(E) performing hot-melt spinning on the mixed material in a spinning machine to spin a yarn from an outlet of the spinning machine to form a primary wire, the plurality of TPU rubber particles, after being hot-melted, being further coated on an outer peripheral side of the primary wire spun from the outlet to form a first-phase wire;

(F) forcibly cooling the first-phase wire to perform a first cooling on the wire to shape a surface of the first-phase wire;

(G) stretching the cooled first-phase wire through a stretching apparatus for stretching;

(H) cooling the first-phase wire to perform a second cooling on the wire to shape an inside of the first-phase wire to form a second-phase wire; and (I) collecting the second-phase wire to make the wire into a finished deodorant and antibacterial copper nanofiber yarn.

2. The manufacturing method as claimed in claim 1, wherein the first fiber yarn slurry is selected from a group consisting of a cotton fiber, a Dacron fiber, a viscose fiber, and a modal fiber.

3. The manufacturing method as claimed in claim 1, wherein the TPU rubber particles comprise TPU, polyethylene (PE), polypropylene (PP), polyethylene terephthalate (PET), polyamide (PA), polybutylene terephthalate (PBT), ethylene-vinyl acetate (EVA) or nylon, and copper modified polyacrylonitrile (PAN).

4. The manufacturing method as claimed in claim 1, wherein the plurality of inorganic particles are rare earth or mineral particle powders.

5. The manufacturing method as claimed in claim 1, wherein the second metal comprises magnesium metal, aluminum metal, manganese metal, titanium metal, zinc metal, iron metal, nickel metal, tin metal, copper metal, or silver metal.

6. The manufacturing method as claimed in claim 1, wherein a standard reduction potential of the first metal ion is greater than a standard reduction potential of an ionic state of the second metal, and a standard reduction potential difference of the first metal ion is greater than a standard reduction potential difference of the ionic state of the second metal by 0.4 V to 4 V.

7. The manufacturing method as claimed in claim 1, wherein a temperature for drying in step D is controlled in a range of 100° C. to 150° C.

8. The manufacturing method as claimed in claim 1, wherein the first cooling in step F makes the first-phase wire continuously pass through a cooling tank, and the second cooling in step H is air cooling.

9. The manufacturing method as claimed in claim 1, wherein the stretching apparatus of step G comprises a plurality of roller sets arranged in sequence to stretch the first-phase wire.

10. A deodorant and antibacterial copper nanofiber yarn, manufactured by using the manufacturing method as claimed in claim 1, the deodorant and antibacterial copper nanofiber yarn containing a first metal nanoparticle, wherein the first metal nanoparticle obtained by reducing a first metal ion, wherein the first metal ion is a copper ion.

11. The deodorant and antibacterial copper nanofiber yarn as claimed in claim 10, wherein an average particle size of the first metal nanoparticle is in a range of 1 nm to 100 nm.

12. The deodorant and antibacterial copper nanofiber yarn as claimed in claim 10, wherein a content of the first metal nanoparticle in the copper nanofiber yarn is in a range of 10 μg to 100 mg per square centimeter of a fiber surface.

* * * * *